US011754355B2

(12) United States Patent
Paulson

(10) Patent No.: US 11,754,355 B2
(45) Date of Patent: Sep. 12, 2023

(54) MINIGUN WITH INTEGRATED BATTERY AND MOTOR CONTROL

(71) Applicant: Kristopher Lee Paulson, Hendersonville, TN (US)

(72) Inventor: Kristopher Lee Paulson, Hendersonville, TN (US)

( * ) Notice: Subject to any disclaimer, the term of this patent is extended or adjusted under 35 U.S.C. 154(b) by 0 days.

(21) Appl. No.: 17/903,980

(22) Filed: Sep. 6, 2022

(65) Prior Publication Data

US 2023/0092536 A1 Mar. 23, 2023

Related U.S. Application Data

(60) Provisional application No. 63/241,022, filed on Sep. 6, 2021.

(51) Int. Cl.
*F41A 9/36* (2006.01)

(52) U.S. Cl.
CPC ..... *F41A 9/36* (2013.01)

(58) Field of Classification Search
CPC .... F41A 9/35; F41A 9/36; F41A 19/64; F41A 19/65; F41A 19/66; F41A 19/68; F41F 1/10
USPC ..... 89/12, 13.05
See application file for complete search history.

(56) References Cited

U.S. PATENT DOCUMENTS

| | | | | |
|---|---|---|---|---|
| 4,924,752 | A * | 5/1990 | Tassie | F41A 7/08 89/12 |
| 4,934,244 | A * | 6/1990 | Johnson, Jr. | F41A 7/10 42/39.5 |
| 5,392,685 | A * | 2/1995 | Stoner | F41A 7/10 89/13.05 |
| 6,443,044 | B1 * | 9/2002 | Dillon | F41A 9/36 89/12 |
| 9,506,705 | B1 * | 11/2016 | Fleischli | F41A 9/31 |
| 10,557,683 | B1 * | 2/2020 | Staffetti | F41G 3/165 |
| 10,871,336 | B1 * | 12/2020 | Johnston | F41F 1/10 |
| 2016/0305740 | A1 * | 10/2016 | O'Donnell | F41F 1/10 |
| 2017/0205167 | A1 * | 7/2017 | Abbott | F41A 7/10 |
| 2020/0158453 | A1 * | 5/2020 | Fitzgerald | F41A 9/36 |
| 2022/0003515 | A1 * | 1/2022 | Alvarez | F41A 19/67 |

* cited by examiner

*Primary Examiner* — Bret Hayes
(74) *Attorney, Agent, or Firm* — Eric B. Fugett; Mark A. Pitchford; Pitchford Fugett, PLLC

(57) ABSTRACT

An electrically driven rotary machine gun includes a drive motor, a feeder delinker, a clutch, and a gun control unit. The drive motor is configured to rotate a rotor of the gun when receiving power. The feeder delinker is configured to provide ammunition cartridges to the rotor while being rotated. The rotor fires the ammunition cartridges while receiving them from the feeder delinker and being rotated by the drive motor. The clutch is configured to selectively engage the rotor and the feeder delinker while actuated. The gun control unit is configured to receive input from a user and provide power to the drive motor as a function of the input received from the user while and to actuate the clutch while providing power to the drive motor. The gun control unit includes a battery to eliminate the necessity of an external power supply.

21 Claims, 7 Drawing Sheets

MINIGUN WITH INTEGRATED BATTERY AND MOTOR CONTROL

CROSS-REFERENCES TO RELATED APPLICATIONS

This application is a non-provisional of and claims priority to U.S. Provisional Patent Application No. 63/241,022 entitled "MINIGUN WITH INTEGRATED BATTERY AND MOTOR CONTROL" filed on Sep. 6, 2021.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronically driven guns (e.g., miniguns). More particularly, this invention pertains to electrically driven machine gun systems and methods.

Referring to prior art FIG. 1, an M134 minigun 100 used in ground warfare and in helicopter or other aircraft warfare is a six-barrel electrically driven rotary machine gun. The M134 minigun 100 is conventionally powered by an external battery pack or power supply 105. The external battery 105 requires heavy cabling to provide power to the minigun drive motor 107, solenoid 109, and booster motor 111.

The M134 minigun 100 operates as an "on/off" machine upon activation by pulling the trigger or pressing a button switch 113. That is, the gun 100 operates at a fixed rate of fire. The gun may 100 be selectable between two fixed fire rates via a switch. That is, the gun 100 may have a high setting of 4000 rounds per minute and a low setting of 2000 rounds per minute, and the setting is selectable via a 2 position switch.

These attributes create drawbacks in the current minigun design. First, the requirement of an external battery pack or power source 105 and the associated cabling require additional weight and space. This is a particularly acute issue for aircraft which are operating under severe weight and space constraints in order to maximize range, speed, and ammunition. For vehicle powered installations, the minigun 100 depends on a fully operable aircraft or vehicle. That is, when the vehicle electrical system 105 is disabled or disconnected for any reason, the minigun 100 cannot fire.

The conventional prior art minigun 100 relies on an external battery pack 105 or power supply having electrical cables supplying power to the drive motor 107, to the solenoid 109 that activates the clutch 125, and to the booster motor 111. When the push button 113 is engaged, full power is provided to the drive motor 107, the solenoid 109, and the booster motor 111 simultaneously from the external power system 105. The drive motor 107 initiates the turning of the rotor 103. The solenoid 109 activates to mate the clutch gear to the feeder delinker assembly 121 (i.e. to the drive gear in the feeder delinker 121). The booster motor 111 begins advancing linked ammunition (e.g., a "chain" of ammunition) into the feeder delinker assembly 121. This single stage process of immediately powering all relevant parts of the gun 100 upon activation of the button 113 initiates the firing action of the minigun 100. The conventional minigun 100 operates on a fixed rate of fire operated by an on/off push button 113 or switch. That is, activating the push button 113 or switch immediately provides full power at a fixed firing rate. A minigun 100 may be operable at one or more fixed rates, e.g., 2000, 3000, 4000 rounds per minute. A conventional minigun 100 has a power cable that connects to the motor control unit (also known as a gun control unit), with two shorter cables connecting to the motor control or gun control unit to the motor 107 and the clutch solenoid 109. The booster motor 111 is also powered by the main power cable.

What is needed, then, are changes to the minigun 100 to reduce weight and space requirements, improve reliability, and increase control over the firing rate of the weapon (i.e., rate of ammunition consumption).

BRIEF SUMMARY OF THE INVENTION

Aspects of the present invention provide an electrically driven rotary machine gun including an onboard power source and infinitely variable rate of fire.

In one aspect, an electrically driven rotary machine gun includes a drive motor, a feeder delinker, a clutch, and a gun control unit. The drive motor is configured to rotate a rotor of the gun when receiving power. The feeder delinker is configured to provide ammunition cartridges to the rotor while being rotated. The rotor fires the ammunition cartridges while receiving them from the feeder delinker and being rotated by the drive motor. The clutch is configured to selectively engage the rotor and the feeder delinker while actuated such that the feeder delinker rotates with the rotor while the clutch is engaging the rotor and the feeder delinker. The gun control unit is configured to receive input from a user and provide power to the drive motor as a function of the input received from the user. The gun control unit is configured to actuate the clutch while providing power to the drive motor.

In another aspect, an electrically driven rotary machine gun includes a drive motor, a feeder delinker, a clutch, and a gun control unit. The drive motor is configured to rotate a rotor of the gun when receiving power. The feeder delinker is configured to provide ammunition cartridges to the rotor while being rotated. The rotor fires the ammunition cartridges while receiving them from the feeder delinker and being rotated by the drive motor. The clutch is configured to selectively engage the rotor and the feeder delinker while actuated such that the feeder delinker rotates with the rotor while the clutch is engaging the rotor and the feeder delinker. The gun control unit is configured to receive input from a user and provide power to the drive motor as a function of the input received from the user. The gun control unit is configured to actuate the clutch while providing power to the drive motor, and the gun control unit comprises a battery.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
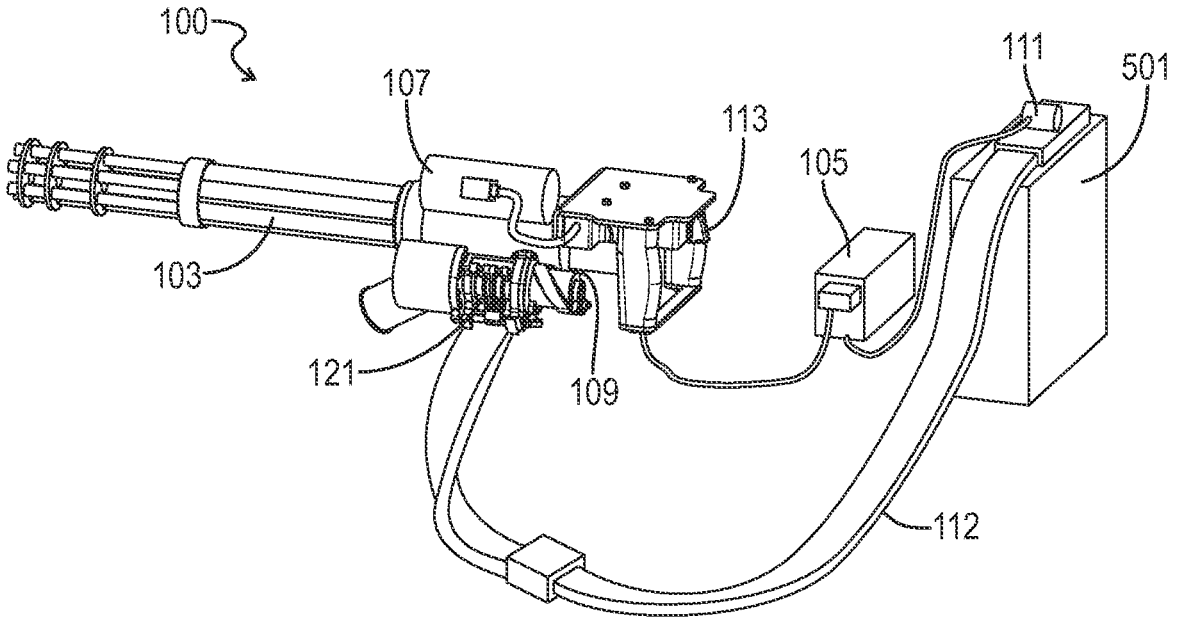
FIG. 1 is an isometric view of a PRIOR ART electrically driven rotary machine gun powered by an external power source.
Figure 2:
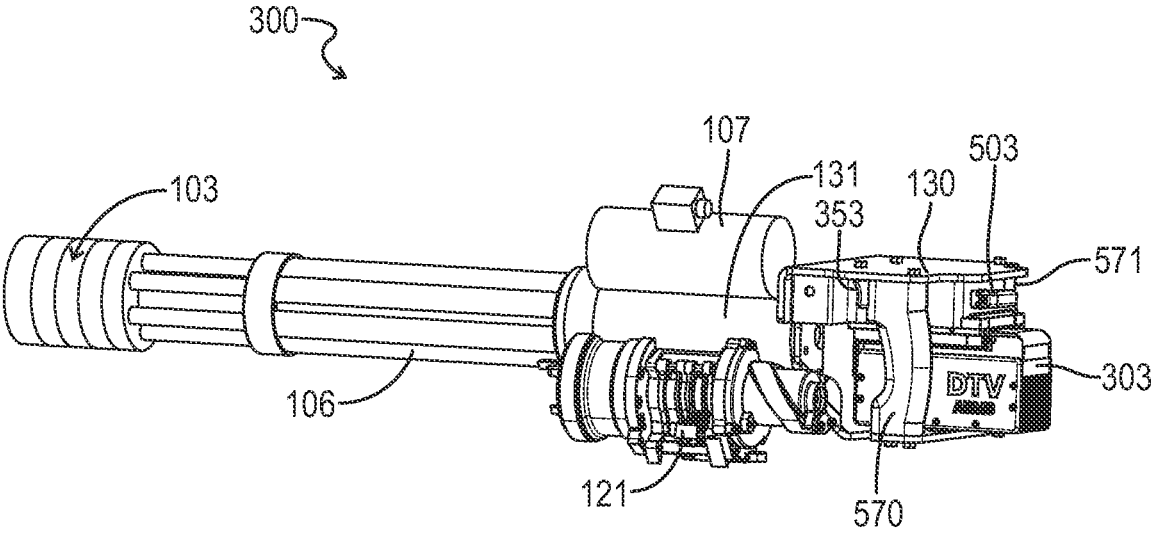
FIG. 2 is a partial side perspective view of an electrically drive rotary machine gun according to one embodiment of the invention.
Figure 3:
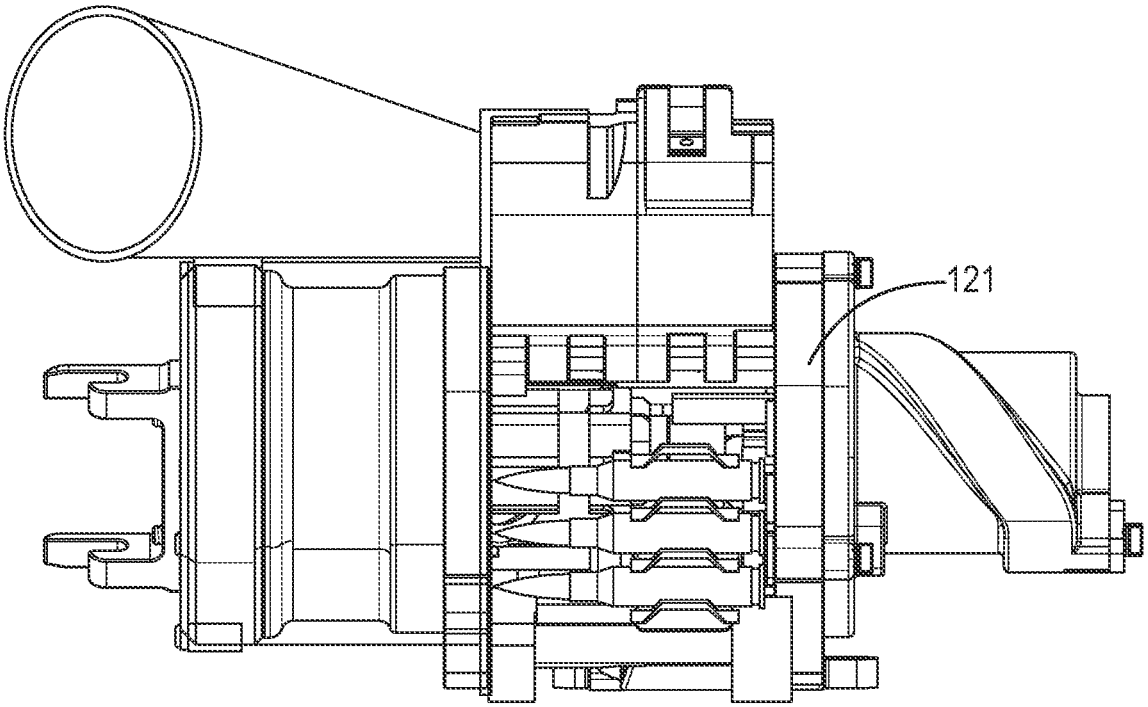
FIG. 3 is a top perspective view of the feeder delinker of the gun of FIG. 2.
Figure 4:
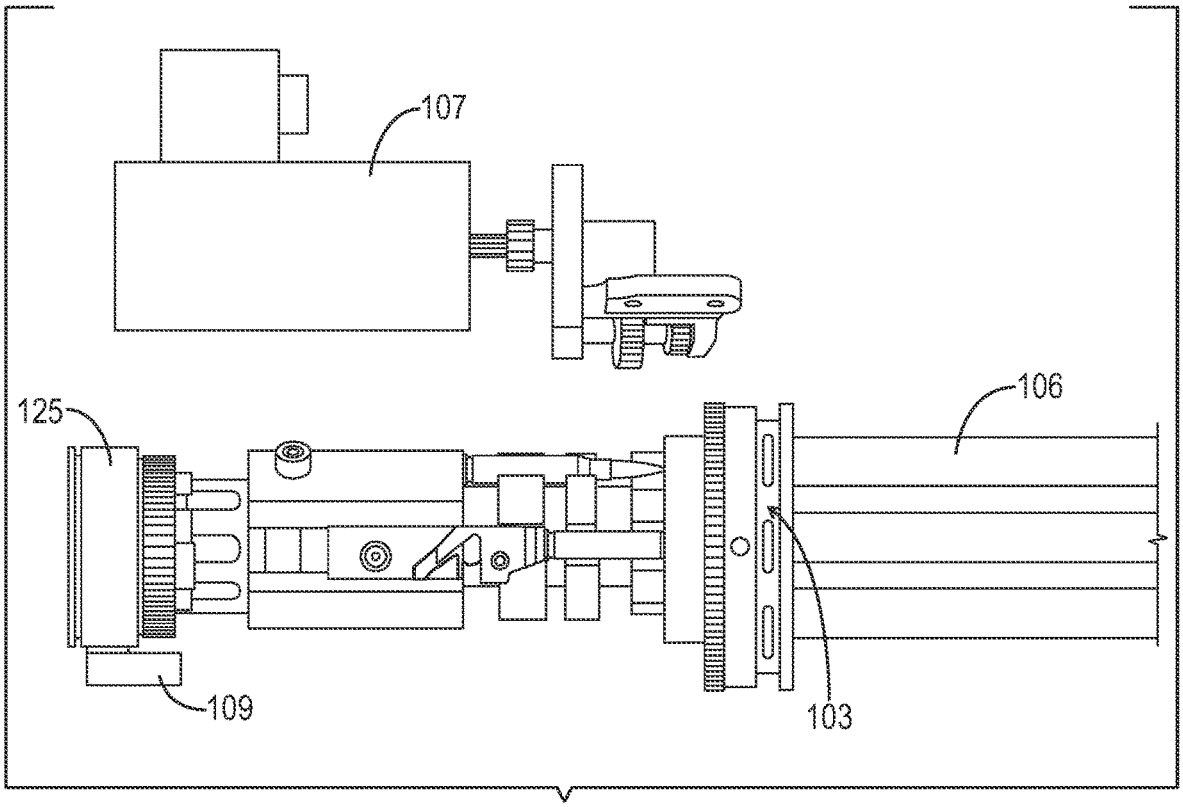
FIG. 4 is a partially exploded side perspective view of the rotor of the gun of FIG. 2.
Figure 5:
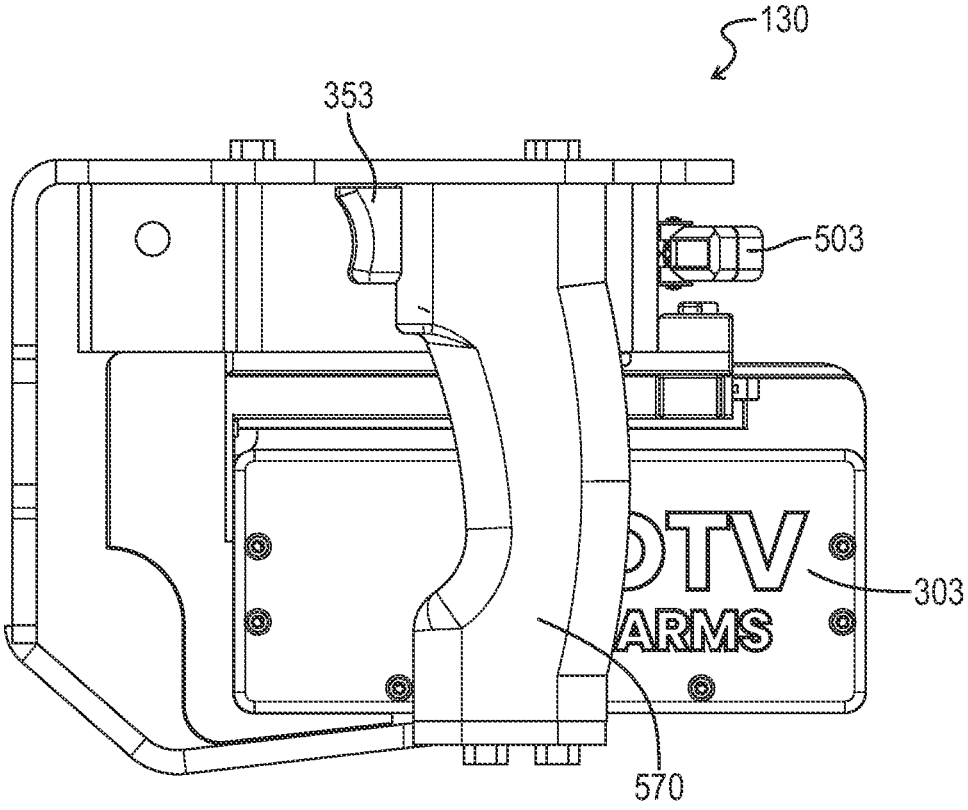
FIG. 5 is a left side perspective view of the gun control unit of the gun of FIG. 2.
Figure 6:
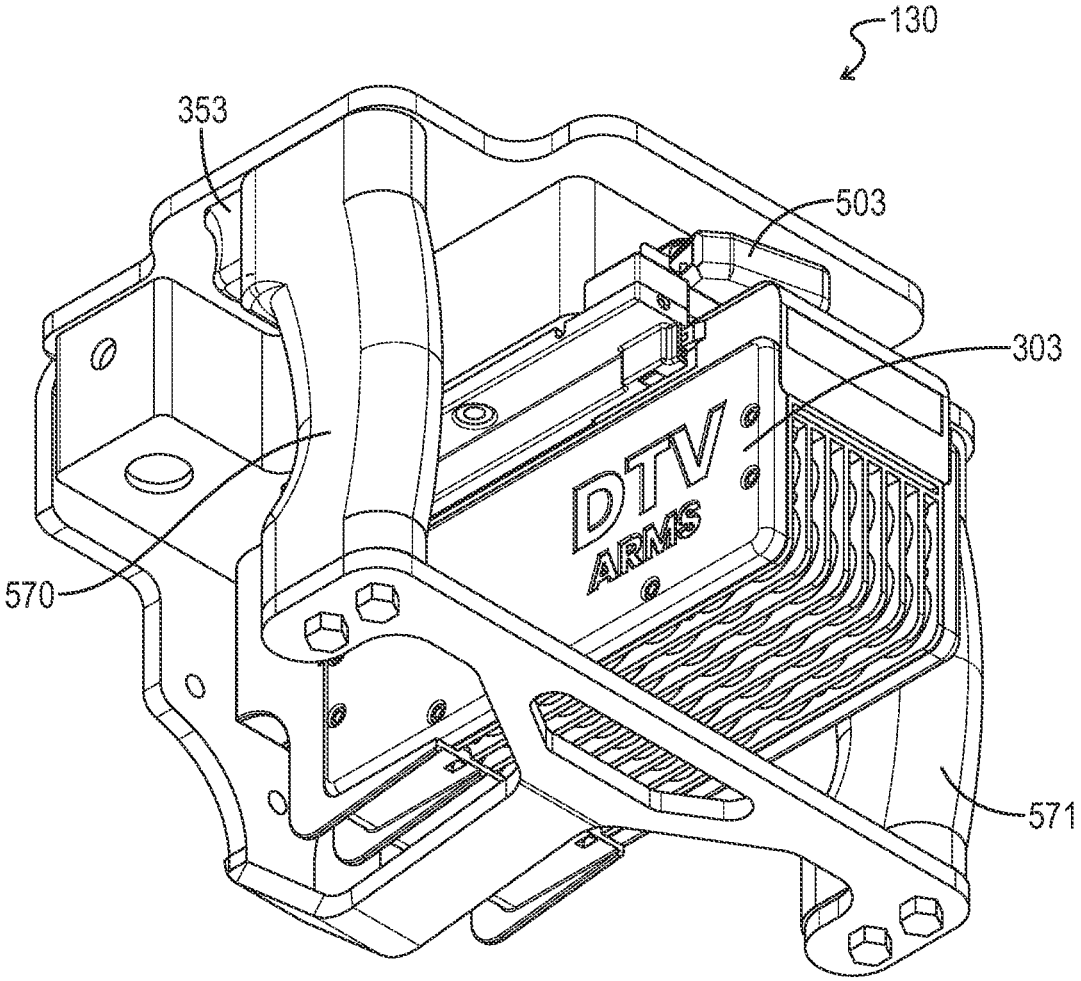
FIG. 6 is a depressed isometric view of the gun control unit of the gun of FIG. 2.
Figure 7:
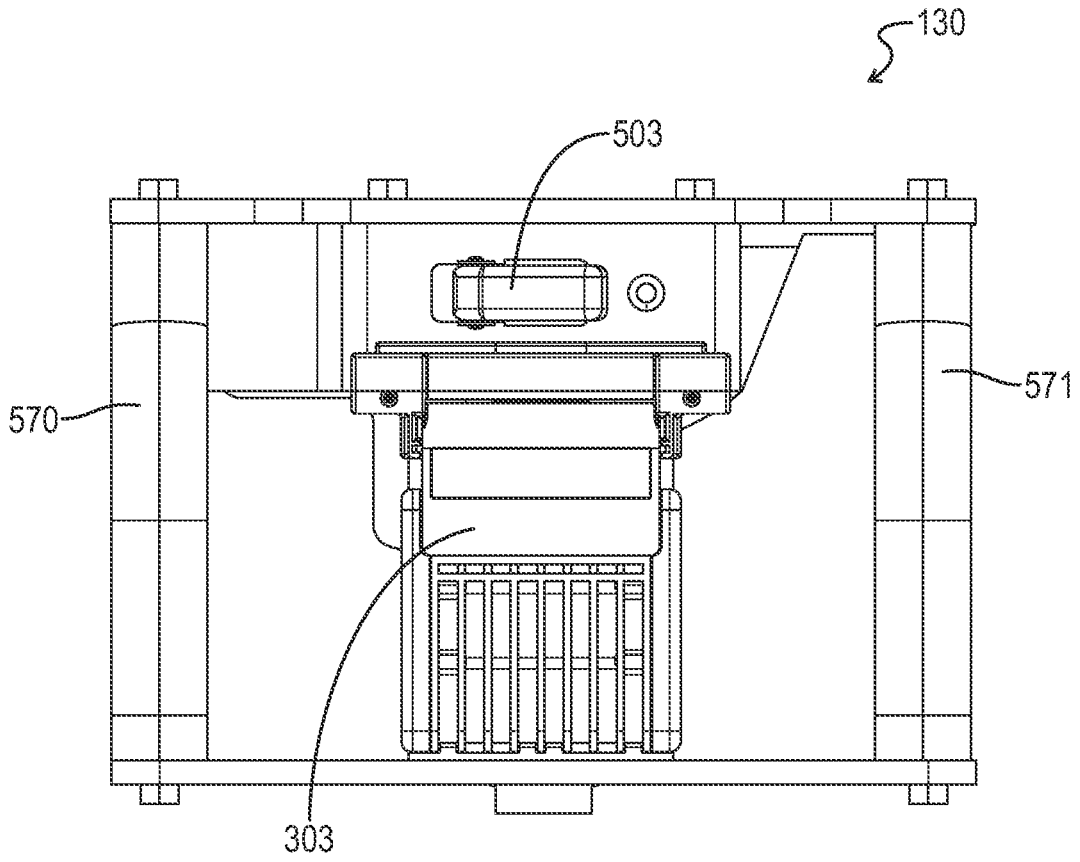
FIG. 7 is a rear perspective view of the gun control unit of the gun of FIG. 2.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein an upright position of the electrically drive rotary machine gun 100 is when fully assembled with the barrels and rotor 103 (i.e., rotor assembly) in a generally horizontal position. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical connection between the connected items or an indirect connection through one or more passive or active intermediary devices.

The term "circuit" means at least either a single component or a multiplicity of components, either active and/or passive, that are coupled together to provide a desired function.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Referring to FIGS. 1-7, an electrically driven rotary machine gun 300 is has an integrated power source 303 and a variable rate of fire. The gun 300 includes a drive motor 107, a feeder delinker 121, a clutch 123, a gun control unit 130, a booster motor 111, and a sleeve 112. The drive motor 107 is configured to rotate the rotor 103 when receiving power. The feeder delinker 121 is configured to provide ammunition cartridges to the rotor 103 while the feeder delinker 121 being rotated internally. The clutch 125 is configured to selectively engage the rotor 103 and the feeder delinker 121 while actuated such that the feeder delinker 121 rotates with the rotor 103 while the clutch 125 is engaging the rotor 103 and the feeder delinker 121.

The gun control unit 130 is configured to receive input from a user and provide power to the drive motor 107 as a function of the input received from the user. The gun control unit 103 is configured to actuate the clutch 125 while providing power to the drive motor 107. The input from the user varies between a zero value and a maximum value. In one embodiment, the gun control unit 130 increases power provided to the drive motor 107 from a predetermined minimum power level corresponding to a minimum rate of fire to a predetermined maximum power level corresponding to a maximum rate of fire linearly as the input from the user increases linearly from a minimum, nonzero value to the maximum value. That is, as the user pulls a trigger 353 of the gun control unit 130 rearward, after a small take-up distance, the input reaches a predetermine minimum value (e.g., some resistance or voltage above zero), the gun control unit 130 powers up the drive motor 107 and begins to fire the gun 300 at a predetermined minimum rate of fire. As the user increases the travel distance of the trigger 353, (i.e., pulls the trigger further rearward) the gun control unit 130 increases the power provided to the drive motor 107 and thus the rate of fire of the gun 300 in direct proportion to the additional travel distance of the trigger 353. In another embodiment, the rate of fire increase is slower as the input value increases, and as the input from the user varies between the minimum nonzero value to the maximum value, the gun control unit 130 increases the power provided to the drive motor 107 from the predetermined minimum power level corresponding to the minimum rate of fire to the predetermined maximum power level corresponding to the maximum rate of fire exponentially is the input from the user increases linearly from the minimum nonzero value to the maximum value.

In one embodiment, the gun control unit 103 includes a number of provisions for soft starting or ramp up of the drive motor 107, clutch 125, booster motor 111 to improve operation, power consumption, reliability and safety of the gun 300. Similarly, shutdown of the gun 300 is accomplished more intelligently than simply cutting power to the drive motor 107, clutch 125 (e.g., a solenoid 109 associated with and actuating the clutch assembly of the clutch), and the booster motor 111. The gun control unit 130 includes a controller having a plurality of timers or processors and switches in order to accomplish these effects. In one embodiment, the gun control unit 103 is configured to actuate the clutch 125 (e.g., via the solenoid 109) after a first predetermined delay from beginning to provide power to the drive motor 107. The first predetermined delay allows the drive motor 107 and rotor 103 a fraction of a second to gather momentum before mechanical energy is siphoned off by the clutch 125 to rotate the feeder delinker 121. In one embodiment, the gun 300 further includes the booster motor 111 which is configured to push length ammunition from an in munition canister 501 through sleeve 112 toward the feeder delinker 121 while receiving power from the gun control unit 103. In one embodiment, the gun control unit 103 provides power to the booster motor 111 for a predetermined spin up time or second predetermined delay before actuating the clutch 125. This ensures that ammunition is present at the intake to the feeder delinker 121 and ready to feed into the feeder delinker 121 without the feeder delinker 121 having to pull the ammunition in and reduces instances of jamming of the gun 302 to sudden fluctuations in rotating speeds of the feeder delinker 121 and rotor 103. In one embodiment, when shutting down, the gun control unit 103 is configured to disengage the clutch 125 when the input from the user decreases to a value corresponding to zero rate of fire, and the gun control unit 103 continues providing power to the drive motor 107 for a predetermined clearing time or third predetermined delay corresponding to at least one full rotation of the rotor 103 after disengaging the clutch 125. It should be appreciated that the third predetermined delay or predetermined clear time will vary as a function of the actual or projected rotating speed of the rotor 103. In one embodiment, when the input from the user decreases to the value corresponding to a zero rate of fire (or below that value into the takeup range), the gun control unit 103 is configured to cease providing power to the booster motor 111 immediately (i.e., that is without any intentional delay). This ensures that ammunition is not jammed at the intake to the feeder delinker 121 as the gun 300 shuts down.

In one embodiment, the gun 300 (e.g., the clutch 125) includes the solenoid 109. The solenoid 109 is configured to bias the clutch 125 (i.e., clutch assembly) toward engagement with the rotor 103 and feeder delinker 121 while the solenoid 109 is receiving power. The gun control unit 103 selectively actuates the clutch 125 by selectively providing power to the solenoid 109 and disengages the clutch 125 by ceasing to provide power to the solenoid 109.

In one embodiment, the gun control unit 130 further includes a master arm switch 503. The master arm switch 503 has an armed position and a disarmed position. When in the disarmed position, the master arm switch prevents the input from the user from indicating any value other than zero and/or prevents the gun control unit 130 from providing power to the drive motor 107. In one embodiment, the gun control unit 130 further includes a status light. The status light is visible to a user behind the gun (in a position to fire the gun). When the master arm switch 503 is armed, the status light is a first color (e.g., green). When the master arm switch 503 is disarmed, the status light is a second color (e.g, red) for a period after switching the master switch 503 to disarmed, and unlit thereafter (to conserve electricity). In one embodiment, the gun control unit 130 uses the status light to indicate a fault detected by the controller. That is, the controller of the gun control unit can determine current and voltage provided to the booster motor 111, drive motor 107, and solenoid 109 and determine a jam or broken component from the determined current and voltage. The gun control unit 130 may turn the status light a third color (e.g., yellow) when the fault is determined, and may also have a flash pattern corresponding to the malfunctioning component.

In one embodiment, the gun control unit 130 includes a rechargeable battery 303, and the gun control unit 130 is configured to provide power from an external power source 105 to the battery 303 while the gun control unit 130 is not providing power to the drive motor 107. That is, the gun control unit 130 recharges or tops off the rechargeable battery 303 from next warrant power source 105 such as a vehicle electrical system whenever the gun 300 is not firing. In one embodiment, the battery 303 is both rechargeable and swappable or interchangeable with any of a plurality of other similar batteries.

In one embodiment, the gun 300 includes housing 131 supporting the rotor 103 such that barrel assembly 106 of the rotor 103 extends forward from the front of the housing 131. The gun control unit 130 is attached to the housing 131 at the rear of the housing 131 opposite the front of the housing 131. In one embodiment, the gun control unit 130 includes a left grip 570 and a right grip 571. The gun control unit 130 also includes a trigger 353 associated with each grip 570, 571. The trigger 353 provides a voltage or resistance level corresponding to the desired rate of fire of the gun 300 as the input from the user to the gun control unit 130. Intuitively for the user, as the user pulls the trigger 323 further rearward or into the grip 570, 571 the input from the user indicates a higher desired rate of fire of the gun 300 to the gun control unit 130.

Referring now to FIGS. 1-7, a minigun 300 including a variable rate of fire and a self-contained power source (i.e., battery 303) is shown. The rotor 103 has six bolt tracks arranged radially around the central axis of the rotor 103. Each bolt track runs longitudinally along the rotor 103. The rotor 103 is situated within a rotor housing 131 having an elliptical cam path. Bolts within the bolt track are guided back and forth by the cam path to receive and fire ammunition. A drive gear at the forward end of the rotor 103 is driven by the motor gearhead when driven by the drive motor 107. The rotation of the drive gear by the drive motor 107 rotates the rotor 103. At the rear end of the rotor 103 is the clutch gear, which mates with the feeder delinker 121. A barrel cluster 106 including a set of six barrels is attached to the cluster head of the rotor 103. A minigun 300 may have a different number of barrels 106. A flash and sound suppressor may also be attached to the end of the barrels 106.

The rotor 103 is driven by the main drive motor 107. In the standard minigun design, the motor 107 is located at about the 10 o'clock position above the rotor 103 when standing behind the minigun 300 in the firing position. The main drive motor 107 drives a gearhead. The gearhead is fitted to drive the rotor drive gear of the rotor 103 as described above.

Beneath the drive motor 107 on the left side of the gun 300, when viewed from behind, is the feeder delinker assembly 121. The feeder delinker 121 receives the linked ammunition, delinks each cartridge, and feeds the cartridge into the guide bar attached to the rotor housing 131. The guide bar guides the ammunition onto the bolt head to start its cycle of operation inside the weapon. To meet the precise timing sequence for loading the cartridges onto the bolts, the feeder delinker assembly 121 also has a feeder drive gear that is driven by the clutch gear of the clutch 125 when the clutch 125 is actuated or engaged. The clutch gear is timed to mate with the feeder delinker drive gear.

The linked ammunition is assisted to the feeder delinker 121 by a booster motor 111 attached to a cog wheel that pulls the linked ammunition from the ammunition can or holder 501 and pushes the ammunition through the sleeve 112 to the feeder delinker 121. The booster motor 111 may be specified to operate on 28 V dc at 2.5 amp, although other motors could be powered at rated specifications by the gun control unit 130.

The minigun 300 disclosed herein has a programmable motor control unit 130 with an integrated battery 303. The integrated battery 303 may be a lithium ion battery pack. By providing an integrated battery 303, the heavy external battery 105 and associated cabling for connecting to the motors 107, 111 and solenoid 109 are no longer needed. These can be removed from the aircraft to save weight during flight.

The motor control unit 130 is provided at the rear end of the weapon for access and manipulation by the weapon operator. The integrated battery 303 may be connected or attached directly to the motor control unit, as shown in FIG. 1. The motor control unit may also have a master arm switch 503. The master arm switch 503 acts as a safety mechanism that must be activated in order to fire the gun 300. This prevents battery 303 drainage by allowing the motor control unit 130 to be switched off and prevents accidental firing if the trigger 353 is inadvertently engaged.

The motor control unit 130 may contain a proportionate power control allowing for variable rate of fire. More specifically, the motor control unit 130 may provide a proportional increase in power supplied to the drive motor 107 and booster motor 111 to permit variable firing rates. For variable firing, the trigger 353 is electrically connected to the motor control unit 130 such that as the trigger 353 travels over a distance from neutral, the speed of the main drive motor 107 (and therefore the rate of fire) increases or decreases as the trigger travel distance increases or decreases. A typical minigun trigger 353 travels about 25-30 mm from unengaged to fully engaged, although a longer or shorter trigger distance may be used. Accordingly, a short trigger travel distance (e.g., 5-10 mm) produces a lower rate of fire, while a longer trigger travel distance (e.g. 20-25 mm) produces a proportionally or exponentially higher rate of fire up to the minimum rate of fire of the gun 300. Both the minimum and the maximum rates may be programmable, rather than fixed. For example, in one embodiment, the minimum rate of fire upon initial trigger pull may be programmed to 1000 rounds per minute, and the maximum rate of fire when the trigger 353 is fully engaged may be programmed to 3000 rounds per minute. A technician or operator may program different maximum and minimum firing rates if desired.

To manage the variable speed, the motor control unit 130 is programmed to power the drive motor 107, the solenoid 109, and the booster motor 111 concurrently. However, the drive motor 107 and booster motor 111 are only powered up proportionally to the speed based on the proportional distance travelled by the trigger, and these speeds (i.e., power levels) are synchronized to maintain the proper firing sequence through the weapon system. During the firing sequence, drive motor 107 turns the rotor 103 at the speed determined by the proportional travel of the trigger 353. The solenoid 109 mates the clutch gear to the feeder drive gear, and the booster motor 111 feeds the linked ammunition into the feeder delinker 121.

Upon trigger 353 release, the solenoid 109 de-powers immediately upon release while the booster motor 111 has a few milliseconds delay to de-power. This stops the ammunition feed into the gun 300. The delay in the drive motor 107 is timed to permit at least one full rotation of the rotor 103 and barrel assembly 106 at the lowest rate of fire. This permits all rounds to be cleared from the gun to reduce the chance of an accidental firing. In at least one embodiment the main drive motor 107 spins for (i.e., remains powered for) an additional 60 milliseconds to clear all arounds in the gun. Upon release of the trigger 353 (or moving to a position corresponding to a zero rate of fire such as the end of the take up distance), the clutch solenoid 109 is de-powered immediately. The booster motor 111 has a few millisecond delay before de-powering to remove any slack from the belt of ammunition still inside the feed chute or sleeve 112. The clutch 125 disengagement stops the feed of ammunition into the gun 300 rotor 103 by releasing the feeder delinker assembly 121 from being driven by the drive motor 107. The drive motor 107 remains powered for a short delay. The delay is timed such that the drive motor 107 remains powered for at least one full rotation of the rotor 103. This causes all ammunition still in the rotor 103 to be fired, so that the rotor 103 and barrels 106 are empty. This prevents accidental discharge. Once the delay is completed, the drive motor 107 is also de-powered.

In one embodiment, the gun control unit 130 includes a control board and wiring in one embodiment. The control board or controller is connected to one or more batteries 303. The controller may include multiple relays and solenoids to handle inrush currents in the drive motor 107, actuator solenoid 109, and booster motor 111. The controller varies the power provided via the wires to the drive motor 107 and booster motor 109 via a pulse width modulation scheme that increases duty cycle to increase provided power. In another embodiment, the controller increases power via a current limiting circuit or a voltage limiting circuit. In one embodiment, the controller activates a relay during the spin up delay to provided rated power to the drive motor 107 during initiation of the motor, then transitions to a PWM (pulse width modulated) or voltage limited drive circuit to maintain a rate of fire corresponding to the input from the user.

There are numerous advantages to the minigun 300 disclosed herein. The gun 300 has an independent power system based on the battery 303 housed in the grip unit of the gun control unit 130. This provides the gun 300 with an independent power source 303 (i.e., not dependent on an external power supply 105. The minigun 300 can be used as an independent ground weapons platform running off the battery power source 303, without any vehicle power connection. Even with respect to minigun designs having an external battery pack, heavy inflexible and vulnerable power cables are necessary to connect the battery pack 105 to the motors 107, 111 and clutch solenoid 109. The integrated battery power source 303 also eliminates the need for cables connecting the minigun 300 to the vehicle power source or to an external battery pack 105. This reduces weight, allowing the vehicle to carry more fuel and/or ammunition, or other supplies. In addition, the motor control allows for variable rate of fire, permitting the operator to conserve ammunition and respond intuitively with an appropriate rate of fire in response to rapid changes in a particular engagement. These and other advantages will be realizable to a person of ordinary skill in the art.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media. As used herein, server is not intended to refer to a single computer or computing device. In implementation, a server will generally include an edge server, a plurality of data servers, a storage database (e.g., a large scale RAID array), and various networking components. It is contemplated that these devices or functions may also be implemented in virtual machines and spread across multiple physical computing devices.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MINIGUN WITH INTEGRATED BATTERY AND MOTOR CONTROL it is not intended that such references be construed as limitations upon the scope of this invention except as set forth in the following claims.

What is claimed is:

1. An electrically driven rotary machine gun comprising:

a drive motor configured to rotate a rotor when receiving power;

a feeder delinker configured to provide ammunition cartridges to the rotor while being rotated;

a clutch configured to selectively engage the rotor and the feeder delinker while actuated such that the feeder delinker rotates with the rotor while the clutch is engaging the rotor and the feeder delinker; and a gun control unit configured to receive input from a user and provide power to the drive motor as a function of the input received from the user; wherein:

the gun control unit is configured to actuate the clutch while providing power to the drive motor, the input from the user varies between a zero value and a maximum value, and the gun control unit increases power provided to the drive motor from a predetermined minimum power level corresponding to a minimum rate of fire to a predetermined maximum power level corresponding to a maximum rate of fire linearly as the input from the user increases linearly from a minimum, non-zero value to the maximum value.

2. The electrically driven rotary machine gun of claim 1, wherein:

the gun control unit is configured to actuate the clutch after a first predetermined delay from beginning to provide power to the drive motor.

3. The electrically driven rotary machine gun of claim 1, wherein:

the gun further comprises a booster motor configured to push linked ammunition from an ammunition canister through a sleeve toward the feeder delinker while receiving power from the gun control unit.

4. The electrically driven rotary machine gun of claim 2, wherein:

the gun further comprises a booster motor configured to push linked ammunition from an ammunition canister through a sleeve toward the feeder delinker while receiving power from the gun control unit; and the gun control unit provides power to the booster motor for a second predetermined delay before actuating the clutch.

5. The electrically driven rotary machine gun of claim 4, wherein:

the gun control unit is configured to disengage the clutch when the input from the user decreases to a value corresponding to zero rate of fire; and the gun control unit is configured to continue providing power to the drive motor for a third predetermined delay corresponding to at least one full rotation of the rotor after disengaging the clutch.

6. The electrically driven rotary machine gun of claim 1, wherein:

the gun further comprises a booster motor configured to push linked ammunition from an ammunition canister through a sleeve toward the feeder delinker while receiving power from the gun control unit; and the gun control unit is configured to cease providing power to the booster motor when the input from the user decreases to a value corresponding to a zero rate of fire.

7. The electrically drive rotary machine gun of claim 1, wherein:

the gun further comprises a solenoid configured to bias the clutch toward engagement with the rotor and feeder delinker while the solenoid is receiving power; and the gun control unit selectively actuates the clutch by selectively providing power to the solenoid and disengages the clutch by ceasing to provide power to the solenoid.

8. The electrically driven rotary machine gun of claim 1, wherein:

the gun control unit further comprises a master arm switch having an armed position and a disarmed position, said master arm switch, when in the disarmed position, is configured to at least one of:

prevent the input from the user from indicating any value other than zero; or prevent the gun control unit from providing power to the drive motor.

9. The electrically driven rotary machine gun of claim 1, wherein:

the gun control unit comprises a rechargeable battery and the gun control unit is configured to provide power from an external power source to the battery while the gun control unit is not providing power to the drive motor.

10. The electrically driven rotary machine gun of claim 1, wherein:

the gun further comprises a housing supporting the rotor such that a barrel assembly of the rotor extends forward from a front of the housing; and the gun control unit is attached to the housing at a rear of the housing.

11. The electrically driven rotary machine gun of claim 1, wherein:

the gun control unit comprises a battery that is rechargeable and swappable.

12. The electrically driven rotary machine gun of claim 1, wherein:

the gun control unit comprises a grip and a trigger at the grip said trigger configured to receive the input from the user, wherein:

the input from the user is indicative of a desired rate of fire of the gun; and the trigger provides a voltage or resistance level corresponding to the desired rate of fire of the gun as the input from the user.

13. The electrically driven rotary machine gun of claim 1, wherein:

the gun control unit comprises a grip and a trigger at the grip said trigger configured to receive the input from the user wherein:

the input from the user is indicative of a desired rate of fire of the gun; and the input from the user indicates a higher desired rate of fire of the gun as the user pulls the trigger further rearward.

14. An electrically driven rotary machine gun comprising:

a drive motor configured to rotate a rotor when receiving power;

a feeder delinker configured to provide ammunition cartridges to the drive motor while being rotated;

a clutch configure configured to selectively engage the rotor and the feeder delinker while actuated such that the feeder delinker rotates with the rotor while the clutch is engaging the rotor and the feeder delinker; and a gun control unit configured to receive input from a user and provide power to the drive motor as a function of the input received from the user; wherein:

the gun control unit is configured to actuate the clutch while providing power to the drive motor, the gun control unit comprises a rechargeable battery, and the gun control unit is configured to provide power from an external power source to the battery while the gun control unit is not providing power to the drive motor.

15. The electrically driven rotary machine gun of claim 14, wherein:

the gun further comprises a housing supporting the rotor such that a barrel assembly of the rotor extends forward from a front of the housing; and the gun control unit is attached to the housing at a rear of the housing such that the gun control unit extends rearward from the housing.

16. The electrically driven rotary machine gun of claim 14, wherein:

the battery is swappable.

17. The electrically driven rotary machine gun of claim 14, wherein:

the battery is interchangeable with any of a plurality of other compatible batteries.

18. An electrically driven rotary machine gun comprising:

a drive motor configured to rotate a rotor when receiving power;

a feeder delinker configured to provide ammunition cartridges to the rotor while being rotated;

a clutch configured to selectively engage the rotor and the feeder delinker while actuated such that the feeder delinker rotates with the rotor while the clutch is engaging the rotor and the feeder delinker; and a gun control unit configured to receive input from a user and provide power to the drive motor as a function of the input received from the user; wherein:

the gun control unit is configured to actuate the clutch while providing power to the drive motor, the input from the user varies between a zero value and a maximum value, and the gun control unit increases power provided to the drive motor from a predetermined minimum power level corresponding to a minimum rate of fire to a predetermined maximum power level corresponding to a maximum rate of fire exponentially as the input from the user increases linearly from a minimum, non-zero value to the maximum value.

19. An electrically driven rotary machine gun comprising:

a drive motor configured to rotate a rotor when receiving power;

a feeder delinker configured to provide ammunition cartridges to the rotor while being rotated;

a clutch configured to selectively engage the rotor and the feeder delinker while actuated such that the feeder delinker rotates with the rotor while the clutch is engaging the rotor and the feeder delinker;

a solenoid configured to bias the clutch toward engagement with the rotor and feeder delinker while the solenoid is receiving power; and a gun control unit configured to receive input from a user and provide power to the drive motor as a function of the input received from the user; wherein:

the gun control unit is configured to actuate the clutch while providing power to the drive motor, and the gun control unit selectively actuates the clutch by selectively providing power to the solenoid and disengages the clutch by ceasing to provide power to the solenoid.

20. An electrically driven rotary machine gun comprising:

a drive motor configured to rotate a rotor when receiving power;

a feeder delinker configured to provide ammunition cartridges to the rotor while being rotated;

a clutch configured to selectively engage the rotor and the feeder delinker while actuated such that the feeder delinker rotates with the rotor while the clutch is engaging the rotor and the feeder delinker; and a gun control unit configured to receive input from a user and provide power to the drive motor as a function of the input received from the user; wherein:

the gun control unit is configured to actuate the clutch while providing power to the drive motor, the gun control unit comprises a rechargeable battery, and the gun control unit is configured to provide power from an external power source to the battery while the gun control unit is not providing power to the drive motor.

21. An electrically driven rotary machine gun comprising:

a drive motor configured to rotate a rotor when receiving power;

a feeder delinker configured to provide ammunition cartridges to the rotor while being rotated;

a clutch configured to selectively engage the rotor and the feeder delinker while actuated such that the feeder delinker rotates with the rotor while the clutch is engaging the rotor and the feeder delinker; and a gun control unit configured to receive input from a user and provide power to the drive motor as a function of the input received from the user; wherein:

the gun control unit is configured to actuate the clutch while providing power to the drive motor, and the gun control unit comprises a grip and a trigger at the grip, said trigger configured to receive the input from the user, wherein:

the input from the user is indicative of a desired rate of fire of the gun, and the input from the user indicates a higher desired rate of fire of the gun as the user pulls the trigger further rearward.

* * * * *